US008584281B2

(12) United States Patent
Diel et al.

(10) Patent No.: US 8,584,281 B2
(45) Date of Patent: Nov. 19, 2013

(54) SURGERY TABLE HAVING COORDINATED MOTION

(75) Inventors: Mark Diel, Union City, CA (US); Charles Ladd, Union City, CA (US); Steve Lamb, Union City, CA (US)

(73) Assignee: Mizuho Orthopedic Systems, Inc, Union City, CA (US)

( * ) Notice: Subject to any disclaimer, the term of this patent is extended or adjusted under 35 U.S.C. 154(b) by 0 days.

(21) Appl. No.: 13/368,159

(22) Filed: Feb. 7, 2012

(65) Prior Publication Data

US 2012/0255122 A1 Oct. 11, 2012

Related U.S. Application Data

(60) Provisional application No. 61/516,853, filed on Apr. 7, 2011.

(51) Int. Cl.
*A47B 7/02* (2006.01)

(52) U.S. Cl.
USPC ..... 5/608; 5/601; 5/618

(58) Field of Classification Search
USPC ..... 5/607, 608, 610, 611, 613, 616–618, 5/600, 601, 621; 606/240, 241, 242, 244, 606/245; 128/845; 600/415; 601/26; 901/15; 378/209
See application file for complete search history.

(56) References Cited

U.S. PATENT DOCUMENTS

| | | | | |
|---|---|---|---|---|
| 3,584,321 | A * | 6/1971 | Buchanan | 5/601 |
| 4,230,100 | A | 10/1980 | Moon | |
| 4,474,364 | A | 10/1984 | Brendgord | |
| 4,885,998 | A * | 12/1989 | Span et al. | 108/139 |
| 5,444,882 | A | 8/1995 | Andrews et al. | |
| 5,655,238 | A * | 8/1997 | Stickley et al. | 5/618 |
| 6,502,261 | B1 * | 1/2003 | Harwood | 5/611 |
| 6,634,043 | B2 | 10/2003 | Lamb et al. | |
| 7,152,261 | B2 * | 12/2006 | Jackson | 5/600 |
| 7,343,635 | B2 | 3/2008 | Jackson | |
| 7,545,911 | B2 * | 6/2009 | Rietzel et al. | 378/65 |
| 7,565,708 | B2 * | 7/2009 | Jackson | 5/611 |
| 7,739,762 | B2 * | 6/2010 | Lamb et al. | 5/618 |
| 8,449,184 | B2 * | 5/2013 | Diaferia et al. | 378/209 |
| 2004/0133983 | A1 * | 7/2004 | Newkirk et al. | 5/624 |
| 2011/0099716 | A1 * | 5/2011 | Jackson | 5/607 |
| 2012/0144589 | A1 * | 6/2012 | Skripps et al. | 5/624 |

* cited by examiner

*Primary Examiner* — Nicholas Polito
(74) *Attorney, Agent, or Firm* — Theodore J. Bielen, Jr.

(57) ABSTRACT

A surgery table utilizing first and second hinged supports that form a frame supporting a patient. First and second connectors hold the first and second supports to first and second piers. Each pier is formed with a base with a linked positioning mechanism for each connector and support member. Each positioning mechanism utilizes a column and a first arm having a proximal portion and a distal portion. The first arm proximal portion is axially rotatable relative to the first column. The second arm possesses a proximal portion and a distal portion such that the second arm proximal portion is axially rotatable relative to the distal portion of the first arm. The second arm distal portion links to the frame connector. A controller determines the axial rotation of the proximal portions of the first and second arms to determine an overall configuration of the frame.

18 Claims, 11 Drawing Sheets

POSITION & VELOCITY SENSORS
MOTOR
58
56
POSITION & VELOCITY SENSORS
MOTOR
POSITION & VELOCITY SENSORS
MOTOR
POSITION & VELOCITY SENSORS
MOTOR
POSITION & VELOCITY SENSORS
MOTOR
124
HAND PENDANT
ACTIVATOR OF MOTORS
120
MAIN CONTROLLER CIRCUITRY
SOFTWARE
122
118
AUXILL. CONTROL PANEL
AC/DC POWER

SURGERY TABLE HAVING COORDINATED MOTION

CROSS-REFERENCES TO RELATED APPLICATIONS

The present application claims the benefit of U.S. Provisional Patent Application Ser. No. 61/516,853, filed 7 Apr. 2011 and incorporates by reference such provisional patent application, as a whole, to the present application.

BACKGROUND OF THE INVENTION

The present invention relates to a novel and useful surgery table for supporting a patient in a multiplicity of positions to effect medical procedures.

Many surgical procedures require the positioning of patients in order to allow examination, imaging, and surgical practices. For example, spinal surgery requires the patient to be in either a prone, supine, or lateral decubitus position. Moreover, a surgery table useful for spinal surgery also requires height adjustment to accommodate the stature of the surgeon. In addition, Trendelenburg, reverse Trendelenburg, lateral tilt, and flexion/extension, of the patient's spinal column is often necessary. Moreover, any surgery table performing these functions must permit access in viewing to the surgeon, as well as spinal imaging including imaging of the lumbar, thorasic, and cervical regions, utilizing a C-Arm or O-Arm fluoroscope device.

For example, prone position spinal surgery procedures may include a laminectomy, disectomy, posterior or transverse lumbar interbody fusion, osteotomy, pedicle screw insertions, transforaminal lumbar interbody fusion (TLIF), kyphoplasty, cervical disectomy and fusion, correction of scoliosis and other deformities.

Supine position surgery procedures include an anterior lumbar interbody fusions (ALIF), total lumbar disc operation, implanting of an artificial disc, and cervical disectomy and fusion. Also, the lateral decubitus position is used to perform an extreme lateral lumbar interbody fusion (XLIF).

Needless to say, a surgery table suitable for the above medical procedures must be extremely versatile, durable, and accurate in its positioning ability.

In the past, many structures and systems have been proposed concerning medical or surgical chairs, beds, or tables. For example, U.S. Pat. No. 6,499,162 describes a power driven bed using a motor driven piston to adjust a frame.

U.S. Pat. Nos. 6,000,076, 6,971,131, 7,003,828, 7,103,931, and US Patent Publication 2008/0127419 describe control mechanisms using power driven gears to adjust the position and contour of furniture and tables in an independent fashion.

U.S. Pat. Nos. 5,208,928, 5,468,216, 5,579,550, 5,640,730, 5,774,914, 5,862,549, 5,870,784, 7,055,195, 7,331,557, and 7,596,820 teach actuators for chairs and tables which employ lead screws which are actuated by motors, generally in a linear direction.

U.S. Pat. No. 5,659,909 illustrates an operating table support which employs a rack and pinion mechanism to move upper and lower plates in translational directions.

U.S. Pat. No. 4,230,100 shows a chiropractic table which includes three independent frames and a linear movement system utilizing a lead screw.

U.S. Pat. No. 4,474,364 describes a surgical table having hinged sections which are actuated into various configuration by pneumatic or hydraulic cylinders.

U.S. Pat. No. 6,634,043 illustrates a medical table having head and foot ends that are automatically adjustable using hydraulic cylinders.

U.S. Pat. No. 5,444,882 teaches a surgery table having multiple supports that are independently operable by hydraulic cylinders.

U.S. Pat. Nos. 7,152,261 and 7,739,762 show hinged and multi rotatable table supports that are moved by a coordinated drive systems located at the head and foot ends of the table.

U.S. Pat. No. 7,739,762 teaches a surgery table in which the support sections for the patient are moved by dual control of independent elevators.

U.S. Pat. No. 7,565,708 illustrates a patent positioning support having hinged sections that are operated by a cable drive system or a pull-rod assembly.

A surgery table that is capable of positioning a patient in multiple positions to permit surgical procedures in a reliable and accurate manner would be a notable advance in the medical field.

SUMMARY OF THE INVENTION

The present invention relates to a novel and useful surgery table.

The present invention utilizes first and second support members which are hingedly attached to each other to form a frame. In this manner, the first and second support members may be angled upwardly, downwardly, or positioned in a planar orientation. Various platform and pads may be placed on said first and second supports to adequately position a patient for surgery, imaging, or medical examination. In this regard, the frame formed by the first and second support members is radiolucent, being compatible with C-Arm or O-Arm fluoroscopes.

The first and second supports of the frame are respectively held by first and second connectors, one at the surgery table head end and the other at the surgery table foot end of the frame. First and second piers are also found in the present invention and include a base, a column or upward structure that extends from and connects to the base. Each of the first and second piers includes a positioning mechanism linked to the columns and the first and second connectors.

Each positioning mechanism of the first and second piers utilize a first arm having a proximal portion and a distal portion. The first arm proximal portion is axially rotatable relative to the first column. A second arm also possesses proximal portion and a distal portion. The second arm proximal portion is axially rotatable relative to the distal portion of the first arm. The distal portions of the second arms of each positioning mechanism are rotatably linked to the first and second connectors held to the frame, respectively. In this manner, the relative movement of the first and second arms distal portions determine the orientation of the support members of the frame. That is to say, the frame via the positioning mechanisms of the head end and the foot end piers may assume a hinged up, a hinged down, and/or a level orientation. In addition, Trendelenburg or reverse Trendelenburg positions may be achieved by the frame. The latter may be accomplished without changing the height of the hinged mechanism connecting the first and second support members of the frame. Moreover, the frame may achieve a lateral tilt by the use of the positioning mechanism associated with one or more of the piers. Also, motors, worm gears, and cycloidal gears are associated with each of the rotational movements between the distal portions of the first arms and proximal portions of the second arms and the first and second arms rotatable linking to the columns and frame support members respectively. Lateral tilt is also achieved through a rotational gear mechanism, motor drive, and a motor.

Most importantly, a controller is found in the present invention for determining the coordinated degree of rotation of the proximal portions of the first and second arms relative to the piers as well as the degree of rotation between the distal portions of the first arms and the proximal portions of the second arms combined with the lateral tilt, a patient on the frame is positioned commensurate with a particular surgical or medical procedures. It should be noted that the patient may be positioned in the supine, prone, or lateral decubitus positions during any of the above positioning procedures, on a patient platform whose movement is also coordinated with the position of the frame of the table.

In particular, each rotational motion accomplished by the arms or the lateral tilt mechanism, includes one or more sensors or an encoders which signal such movement to a central microprocessor. Appropriate software or a computer program is used to coordinate the movement of the patient platform, the first and second arms and the lateral tilt of the table when positioning the frame. Most importantly, hinged rotation, Trendelenburg positioning and tilt may be pre-determined while fixing the surgery position on the frame on a particular place in space, a fixed position relative to the ground surface. That is to say, the surgery point or fixed surgical site remains totally static relative to a point on the frame during all movements of the table effected by the positioning mechanisms found in the head and foot piers.

Further, control of the positioning of the surgery table of the present invention may be determined by a manually operable command actuator such as a control panel or a hand pendant normally held by the surgeon or assistant to the surgeon performing surgery. The actuator allows the medical practitioner to position the surgery table in any of the heretofore mentioned orientations by the pressing of a single button. Again, the central programmed microprocessor coordinates the received commands and the various table motors to achieve the desired table position, in a robotic like manner.

It may be apparent that a novel and useful surgery table has been hereinabove described.

It is therefore an object of the present invention to provide a surgery table for a patient having a hinged frame for support of the patient to allow intraoperative flexion/extension of the lumbar thoracic regions of the body.

It is therefore another object of the present invention to provide a surgery table which is compatible with C-Arm and O-Arm fluoroscopes for imaging the lumbar, thoracic and cervical regions of the body.

Another object of the present invention is to provide a surgery table which permits surgery on a patient located on a surgery table in the prone position, supine position, or the lateral decubitus position.

Another object of the present invention is to provide a surgery table which allows for a prone patients abdominal fall-out and still permits the use of a fluoroscope for imaging head-to-toe.

A further object of the present invention is to provide a surgery table which permits an anesthesiologist to be stationed at the head end of the table to observe the patients eyes, nose, and mouth.

A further object of the present invention is to provide a surgery table which utilizes a hinged frame to provide maximum flexion or extension, as well as lateral roll of the frame of the table.

Another object of the present invention is to provide a surgery table which utilizes Trendelenburg or reverse Trendelenburg positioning of the patient on the table.

Another object of the present invention is to provide a surgery table which is capable of locating a patient platform that is longitudinally adjustable relative to the table frame location.

A further object of the present invention is to provide a surgery table which may be remotely operated by the surgeon or a person assisting the surgeon to create multiple positioning of the patient on the surgery table by the pressing of a single button.

Another object of the present invention is to provide a surgery table which provides for cervical traction.

Another object of the present invention is to provide a surgery table which is rugged and is able to withstand vibrations and impacts from shipping and applied loads during surgical procedures such as hammering, sawing, drilling, and the like.

Another object of the present invention is to provide a hinged frame surgery table which possesses radiolucency.

Yet another object of the present invention is to provide a surgery table that assumes multiple orientation, but maintains a fixed surgical site during all table movements.

The invention possesses other objects and advantages especially as concerns particular characteristics and features thereof which will become apparent as the specification continues.

For a better understanding of the invention reference is made to the following detailed description of the preferred embodiments of the invention which should be taken in conjunction with the above described drawings.

DETAILED DESCRIPTION OF THE PREFERRED EMBODIMENTS OF THE INVENTION

Various aspects of the present invention will evolve from the following detailed description of the preferred embodiments thereof which should be referenced to the prior described drawings.

Figure 1:
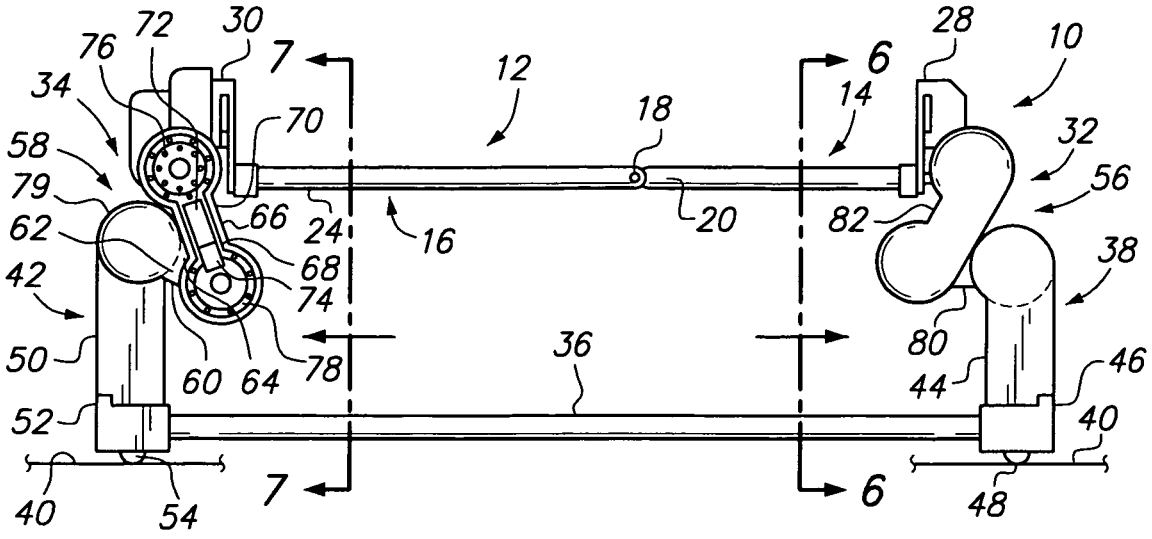
FIG. 1 is a side elevational view of the surgery table of the present invention.
Figure 6:
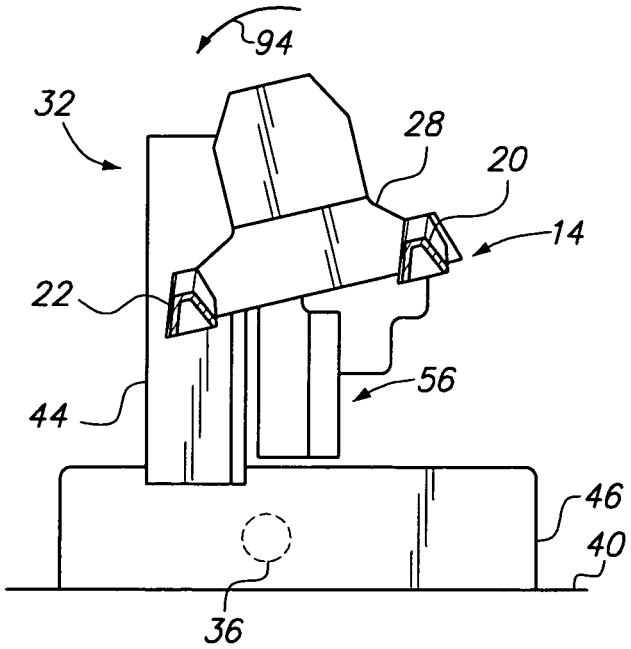
FIG. 6 is a side elevational view of the head end of the surgery table taken along line 6-6 of FIG. 1.
Figure 7:
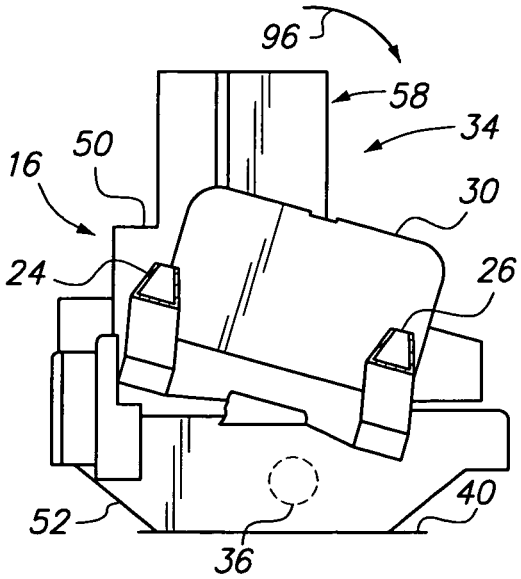
FIG. 7 is an elevational view of the foot end of the surgery table taken along line 7-7 of FIG. 1.

The invention as a whole is depicted in the drawings by reference character 10. Surgery table 10 includes as one of its elements a frame 12. Frame 12 includes a first support member 14 and a second support member 16. The first support member 14 is hingedly attached to second support member 16 via hinges 18 and 19 FIGS. 1 and 9. With reference to FIGS. 6 and 7, it may be observed that first support member 14 includes legs sections 20 and 22. Similarly, second support member 16 possesses leg sections 24 and 26. Of course, a conventional chest, hip/thigh pads and other like our items may be used to hold the patient in a particular orientation (shown on FIG. 3). In this regard, such slidable patent platform 90 takes the form, of the patient support structure and sliding mechanism shown in U.S. Pat. No. 7,739,762, which is incorporated by reference to this application, as a whole. Needless to say, slidable patient platform 90 moves commensurate with hinge rotation of support members 14 and 16 about hinges 18 and 19.

Returning to FIG. 1, it may be apparent that first support member 14 joins to a first plate or connector 28, while second support member 16 joins to plate or connector 30. In general, table 10 possesses a head end 32 and a foot end 34, FIGS. 1 and 9. Spacer or support bar 36 spans head end 32 and foot end 34 and is shown as being fixed, although support bar may be telescopically constructed to allow collapsing of table 10 for storage. In any case, bar 36 remains in a fixed position while positioning the first and second support members 14 and 16 of frame 12, during surgical procedures.

Again, referring to FIG. 1, it should be noted that a first pier 38 extends from floor or ground surface 40 at head end 32 while a second pier 42 extends from floor 40 at foot end 34. Pier 38 includes a connected column 44 having a base 46 which is supported to floor 40 through a lockable wheel mechanism 48. Similarly, pier 42 at foot end 34 possesses a connected column 50 extending from base 52 which also includes a lockable wheel mechanism 54.

First and second piers 38 and 42 include positioning mechanisms 56 and 58, respectively. For example, positioning mechanism 58 at foot end 34 possesses a first arm 60 having a proximal portion 62 and a distal portion 64. A second arm 66 also possesses a proximal portion 68 and a distal portion 70. First arm 60 proximal portion 62 is axially rotatable relative to column 50. Second arm 66 proximal portion 68 is axially rotatable relative to distal portion 64 of first arm 60. The distal portion 70 of second arm 66 links to cycloidal gear 76 which in turn, joins connector plate 30 linked to support member 16. Each arm of positioning mechanisms 56 and 58 is associated with a worm gear box and drive motor. For example, drive motor 72 and worm box 74 is associated with second arm 66 of positioning mechanism 58. Also, cycloidal gear 79 is found at the proximal end of arm 60. Cycloidal gears 76 and 78 are exposed on FIG. 1, with respect to positioning mechanism 58. Needless to say, positioning mechanism 56 is similarly constructed with respect to arms 80 and 82, FIGS. 1, and 3-7.

Figure 2:
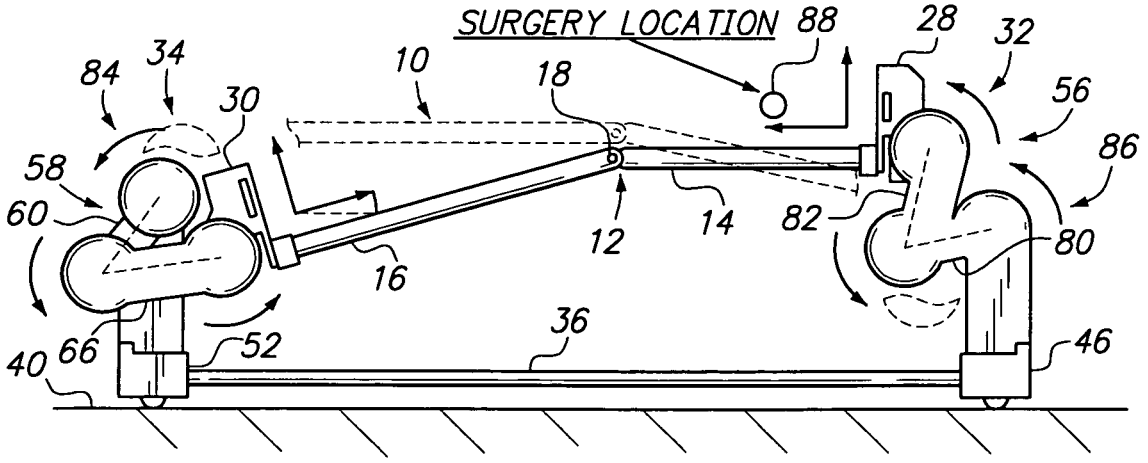
FIG. 2 is a side elevational view of the surgery table of the present invention showing multiple positioning of the frame member while maintaining a fixed surgical site thereby.

Turning to FIG. 2, it may be observed that surgery table 10 has been moved up (phantom rendition) from a slightly angled-up position of frame 12 (solid line) formed by support members 14 and 16. Directional arrows 84 associated with positioning mechanism 58 indicates the relative movements of the cycloidal gears associated with first arm 60 and second arm 66 of positioning mechanism 58. In addition, plurality of directional arrows 86 show the rotational movement of the cycloidal gears of positioning mechanism 56 relative to first arm 80 and second arm 82 of positioning mechanism 56. The location of frame 18 and the orientation of support members 14 and 16 are, thus, determined by certain movements of positioning mechanisms 56 and 58. However, a fixed surgery location or fixed surgical site, denoted by a circle 88, remains the same through such movements. Thus, such ability of surgery table 10 facilitates the performance of surgery on a patient by the surgeon, since the surgeon need not change location during repositionings of table 10.

Figure 3:
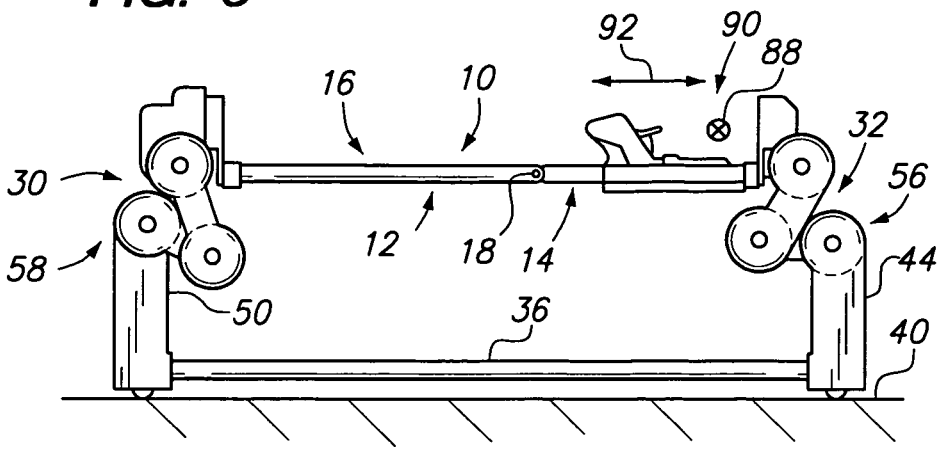
FIG. 3 is a schematic side elevational view of the surgery table of the present invention having a patient platform and with the frame in a level configuration.
Figure 4:
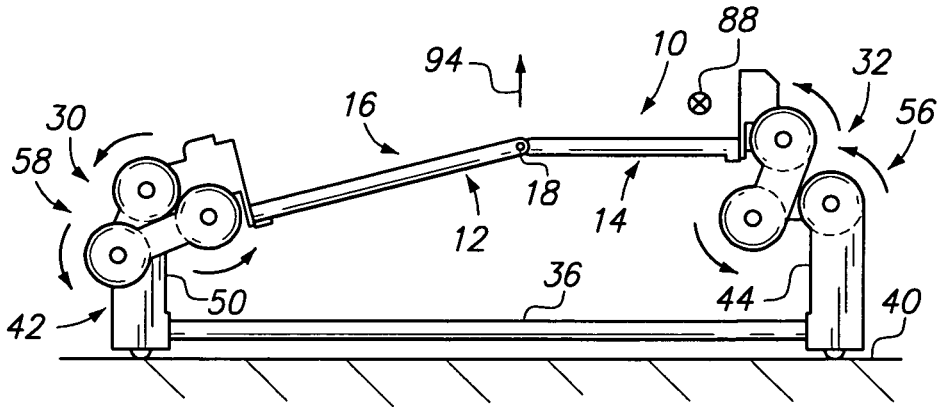
FIG. 4 is a schematic side elevational view of the surgery table of the present invention depicting rotation of the arms of the first and second positioning mechanisms resulting in an angled up orientation.
Figure 5:
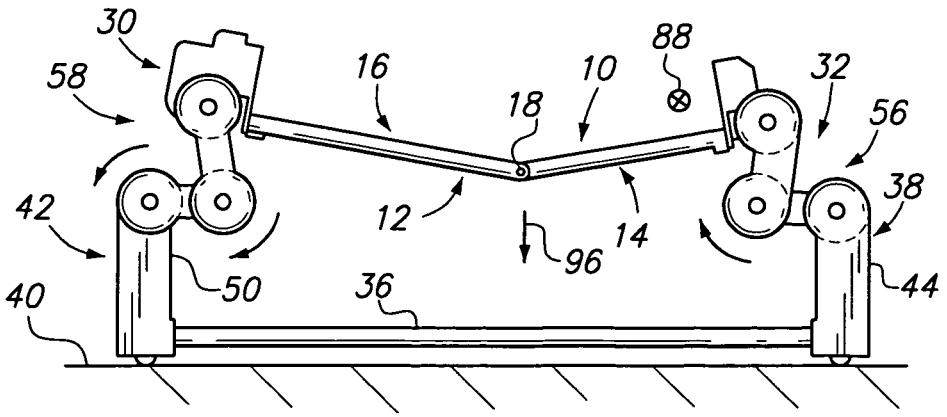
FIG. 5 is a schematic side elevational view of the surgery table of the present invention depicting rotation of the arms of the first and second positioning mechanisms resulting in an angled down orientation.

Turning now to FIGS. 3-5, it may be seen that surgery table 10 is positioned on a ground surface 40. FIG. 3 depicts surgery table 10 in a level position with patient platform 90 located near head end 32 of table 10. Directional arrow 92 indicates the typical movements of patient platform 90 along frame 12, during the hinged rotations of support members 14 and 16. FIG. 4 illustrates an angled up position of frame 12 where hinged portions 18 and 19 have moved upwardly according to directional arrow 94. FIG. 5 illustrates an angled down position of frame 12 where hinged portions 18 and 19 have moved according to directional arrow 96. It should be noted that the fixed surgical site 88 has substantially remained in a constant position in space in relation to ground surface 40 and a particular portion of frame 12.

FIGS. 6 and 7 illustrates the head end 32 and foot end 34 of surgery table 10. It should be seen that frame 18 and support members 14 and 16 have been rotated laterally, a lateral tilt, according to directional arrows 94 and 96 on FIGS. 6 and 7, respectively.

Figure 8:
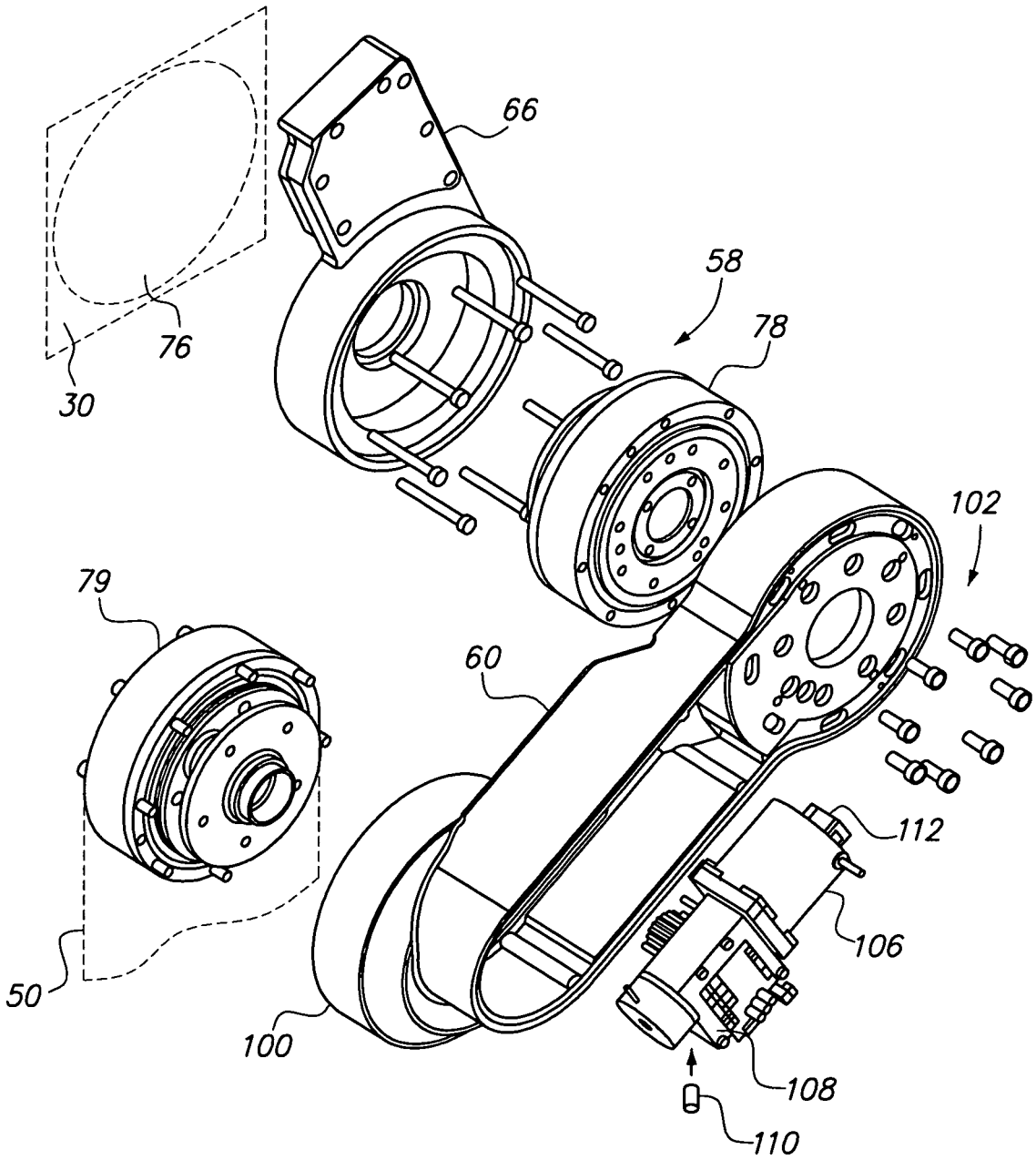
FIG. 8 is an exploded perspective view of a typical first and second arm structure.

Regarding now FIG. 8, a detailed view of a typical positioning mechanism such as positioning mechanism 58, is depicted. Exemplary positioning mechanism 58 is shown having cycloidal gears 76, 78, and 79 (shown schematically). Cycloidal gears 76, 78, and 79 may be of the type identified by the R-series, manufactured by Nabtesco Corporation of Tokyo, Japan. Cast linkage arm 60 includes a cover 100 for cycloidal gear 50 which is linked to column 50, heretofore described in FIGS. 1 and 2. Likewise, cycloidal gear 78 is linked to arm 66 which is rotatably positioned with respect to cycloidal gear 76. Moreover, arms 60 and 66 consist of cast linkage arms. Plurality of fasteners 102 and 104 are depicted in FIG. 8 to hold arms 60, cycloidal gear 78, and arms 66 together. Brushless DC motor 106 is employed to motivate the rotation of arm 60 relative to cycloidal gear 98. Brushless motor 106 may take the form of a model BN 34-35AF-001LH motor manufactured by Moog Inc, of Murphy N.C. Of course, similar motors are associated with the rotation of arms 66 relative to arm 60 as well as the rotation of connector plate 30 and support member 16 relative to arm 66. That is to say, six motors of the type depicted by motors 106, and the gear box and encoder described hereinafter, are associated with positioning mechanisms 56 and 58 embodiment of the present invention. A seventh motor is associated with the tilt function of table 12 which will be discussed hereinafter. With further reference to FIG. 8, a gear box 108 is linked to motor 106. Gear box 108 may be of the type model PIN A-520-2002, manufactured by R. M. Hoffman Company of Sunnyvale, Calif. Absolute encoder or sensor 110, detecting the position of shaft of motor 106, is also affixed to gear box 108 and may be of the type identified as an HDR Pico Blade. Also, optical encoder or sensor 112, measuring of the velocity of motor 106, is attached thereto, and may be of the type identified as an HDR MTA 100.

Figure 9:
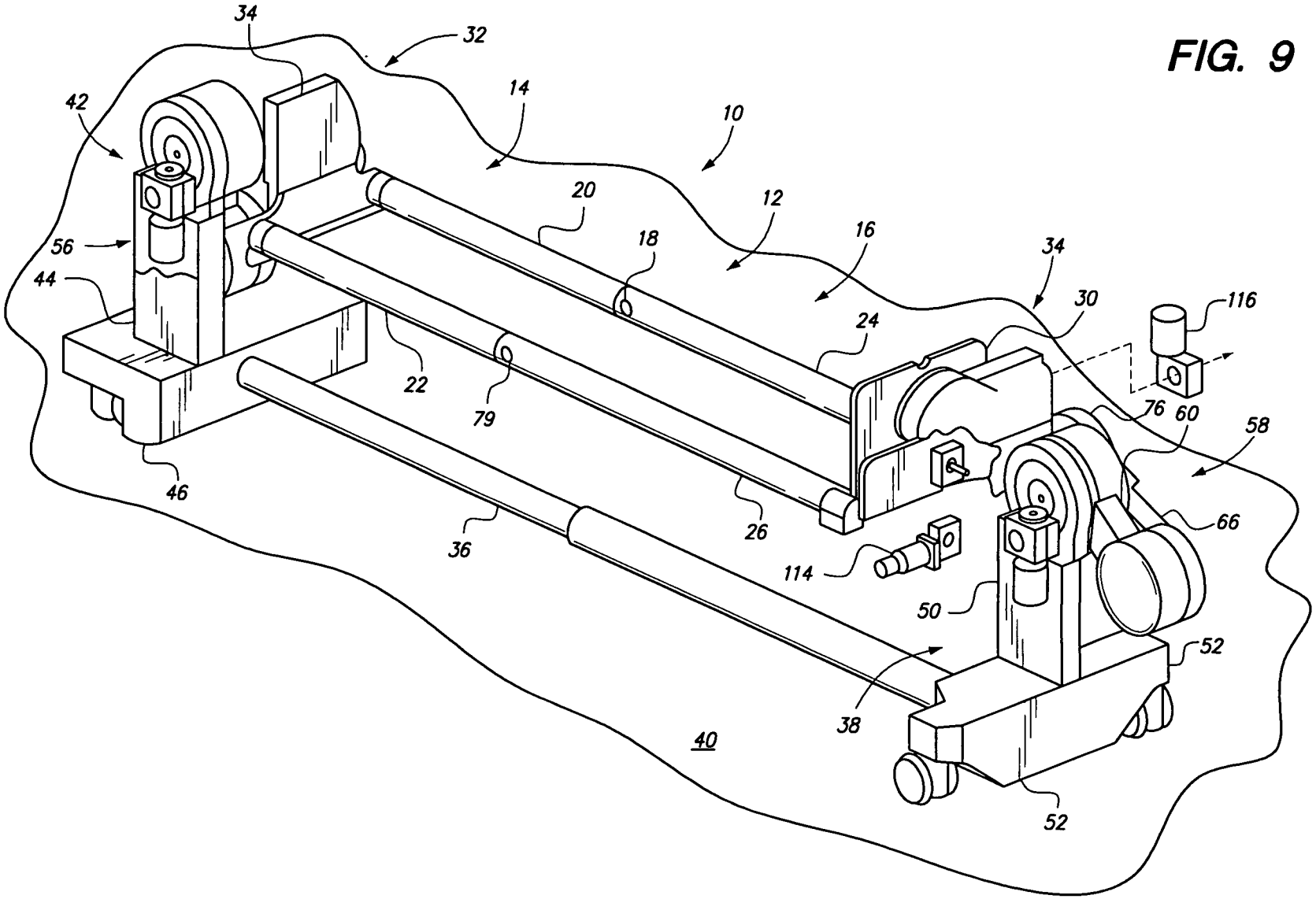
FIG. 9 is a top left schematic perspective view of the surgery table from the foot end thereof.

FIG. 9 further illustrates surgery table 10 and includes the provision of a tilt drive motor 114 which may be of the type model PIN A-520-2012 manufactured by the R. M. Hoffman Company of Sunnyvale, Calif. Also, hinge angle drive motor 116 is depicted in exploded format to operate the angular rotation of support member 16 relative to arm 66. Hinge angle drive motor 116 may be of the type used with respect to arm 60 and 66 depicted on FIG. 8.

Figure 10:
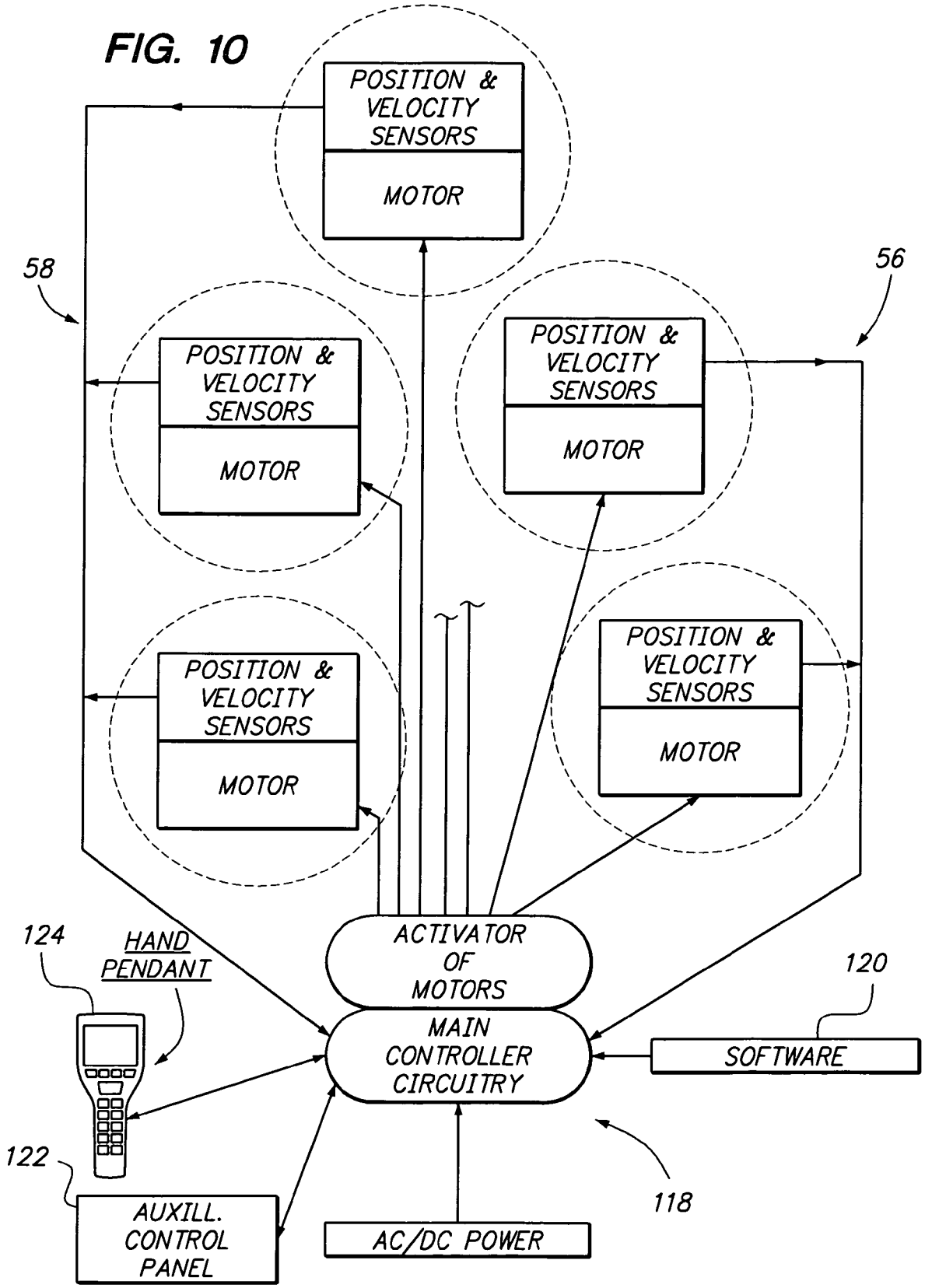
FIG. 10 is a schematic view indicating the interaction between the mechanical elements and the electronic controlling elements of the surgery table of the present invention.

FIG. 10, represents the overall function of a controller 118 associated with positioning mechanisms 56 and 58 and patient platform 90. It should be noted that software 120 is programmed into the circuitry of main controller 118, platform 90, and motor controller processor 152, the latter of which will be further elucidated as the specification continues to activate the motors associated with the movements of arms 60, 66, 80, and 82 support members 14 and 16, patient platform 90, as well as the lateral tilt afforded surgery table 10. Such software or computer programs 120 accompanies this application as an appendix, and is incorporated by reference to this application.

Figure 11:
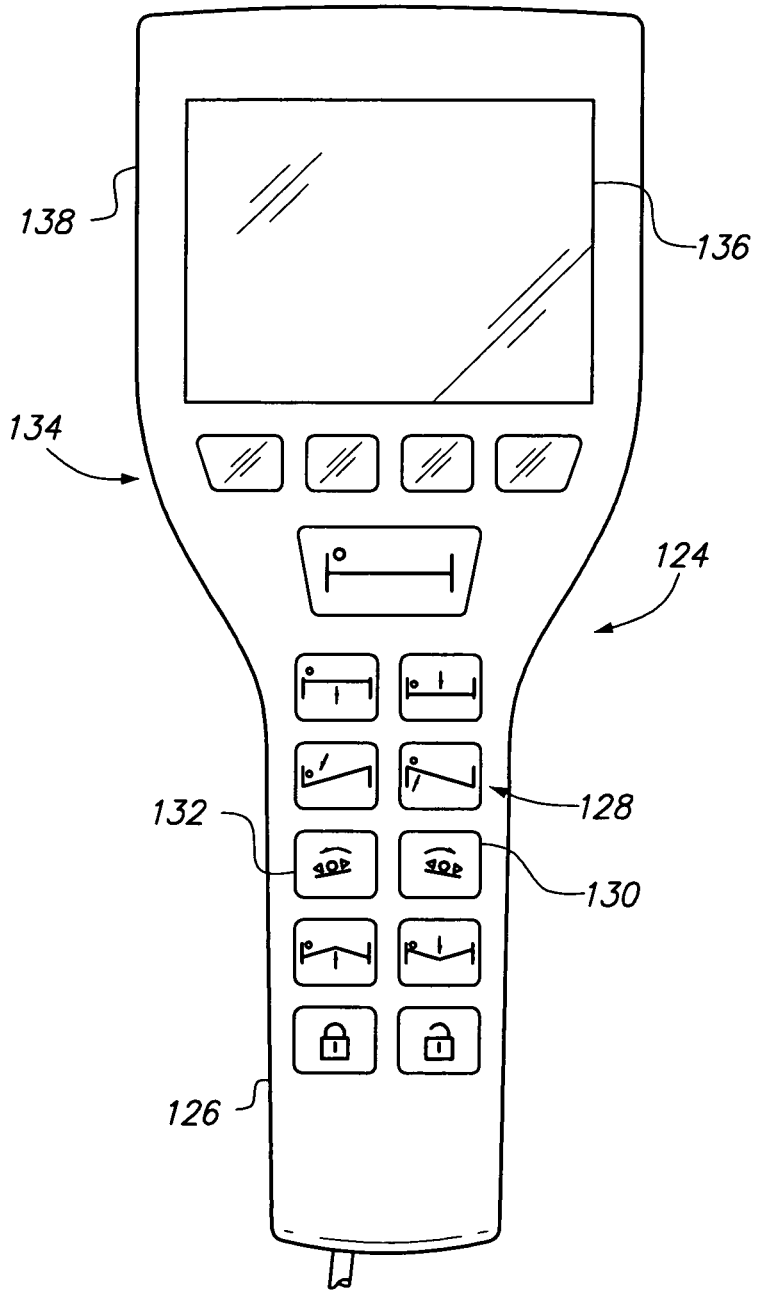
FIG. 11 is a top plan view of a hand pendant employed as manually operable command actuator.

Hand pendant 124, shown in plan view on FIG. 11, is constructed with a lower portion 126 having a button overly 128. The user of hand pendant 124 merely presses and holds a single button of button overlay 128 to position surgical table 10 according to the illustrated table positions on each button. Release of a particular button will stop the movement of surgery table 10. For example, buttons 130 and 132 will cause the lateral tilt of surgery table 10. A similar layout may be employed with a control panel 122 (not shown). Soft keys 134 serve as configuration buttons for determining such parameters as language, speed of movement of table 10, memory functions and the like. Large screen 136 at flared portion 138 of hand pendant 124 provides status information, including table 10 position, battery status, and the like. Position sensors or encoders, such as sensors 110 and 112 of FIG. 8, are associated with each of the motors found in positioning mechanisms 56 and 58 and patient platform 90 serve as feedback for the movement of the above identified items.

Controller 118 may be effected by a manually operable command actuator such as an axillary control panel 122 or a hand pendent 124, the latter of which may be carried by the surgeon or an assistant to the surgeon.

Figure 12:
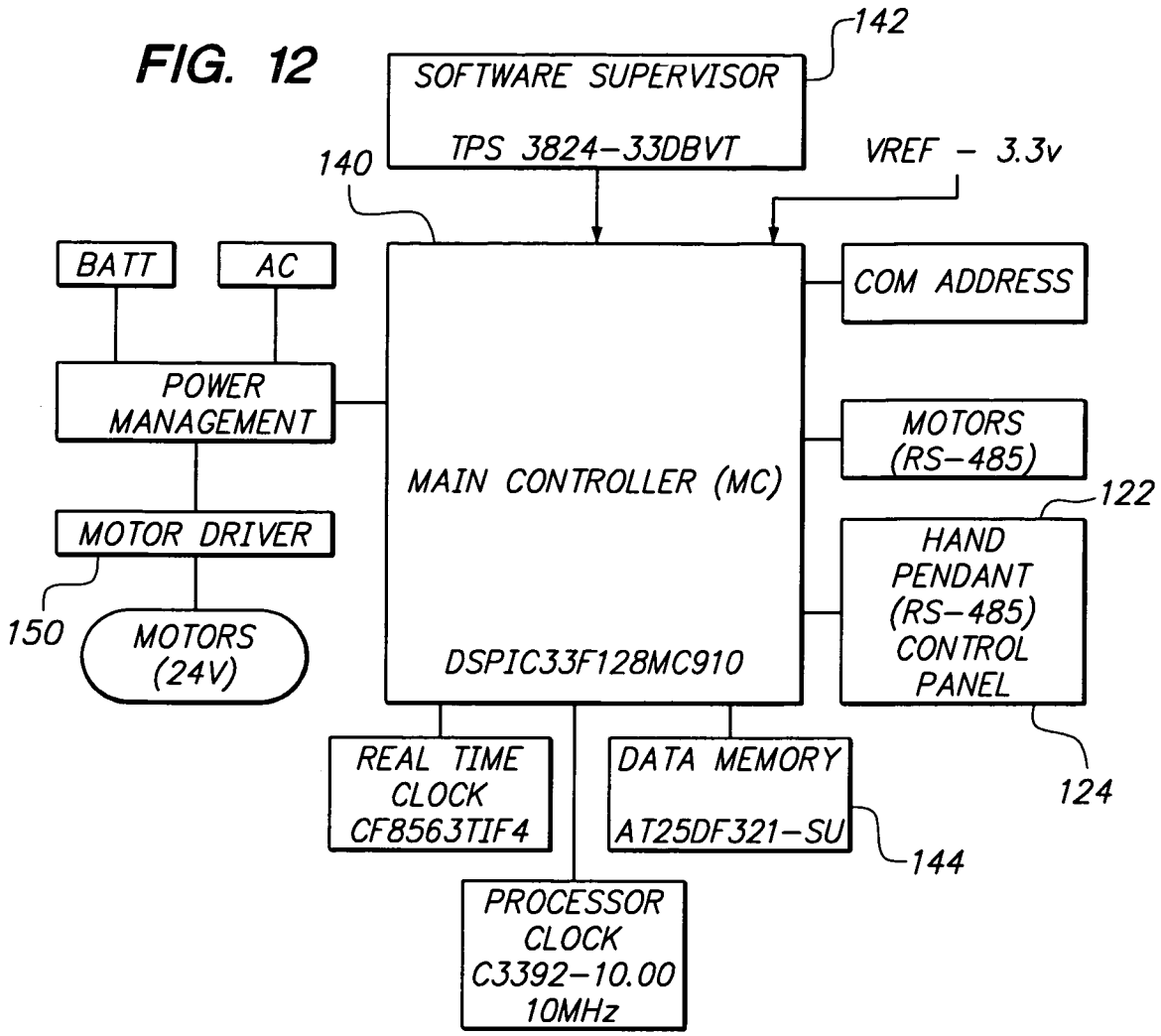
FIG. 12 is block diagram showing the main controller microprocessor in relation to components of the surgery table.
Figure 13:
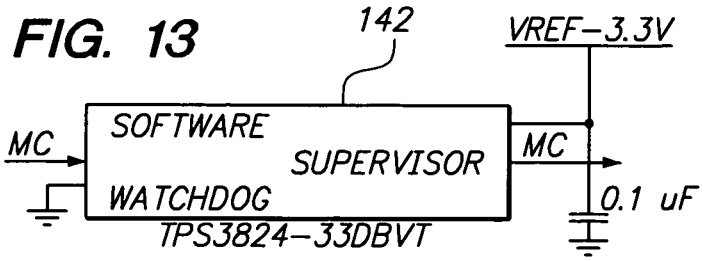
FIG. 13 is an electrical schematic of the software watch dog associated with the main controller.
Figure 14:
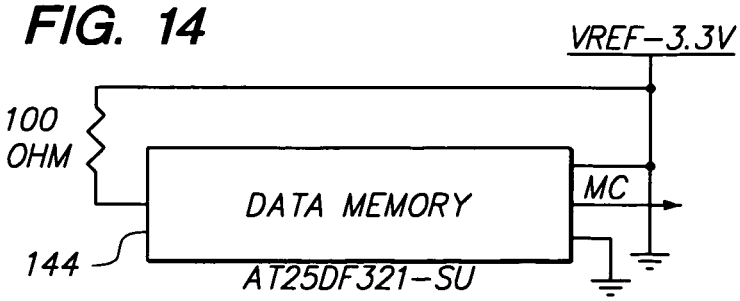
FIG. 14 is an electrical schematic of the data memory associated with the main controller.

FIGS. 12-20 show the circuitry associated with controller 118 to move surgery table 10 according to the overlay 128 on hand pendant 124. The circuitry depicted in FIGS. 12-20 is located on a circuit board within surgery table 10. Various components depicted in FIGS. 12-20 are identified on such figures according to conventional electronic designations. Main controller 140 serves as the host microprocessor and creates the motion commands according to the user input from hand pendant 124 or controller 122. Main controller 140 also functions as a power management control for the electrical system associated with surgery table 10. For example, main controller 140 initiates the charging of back up batteries and switches over to battery power when AC power has been lost. Main controller also serves as a communication hub for the electronics systems depicted in FIGS. 12-20. As shown in FIG. 12, these functions are depicted in block diagram format. As shown in FIG. 12 also, a general reference voltage for the circuitry of the components shown in FIGS. 12-20 is 3.3 volts DC. Such voltage is fed to main controller 140 by conventional voltage regulators and transformers. FIG. 13 depicts the software supervisor 142 which serves as a watch dog should software 120 cease to function. Likewise, if a crash of software 120 occurs, software supervisor 142, resets the system associated with main controller 140. Data memory 144 includes look-up tables and other storage needs for software 120, FIG. 14.

Figure 15:
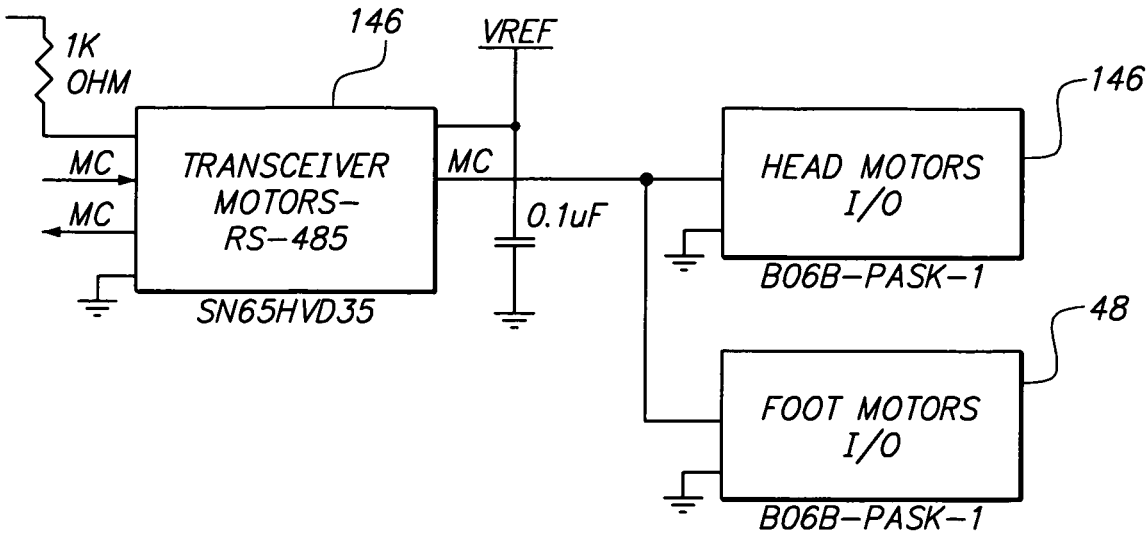
FIG. 15 is an electrical schematic of the RS 485 transceiver for the motor.
Figure 16:
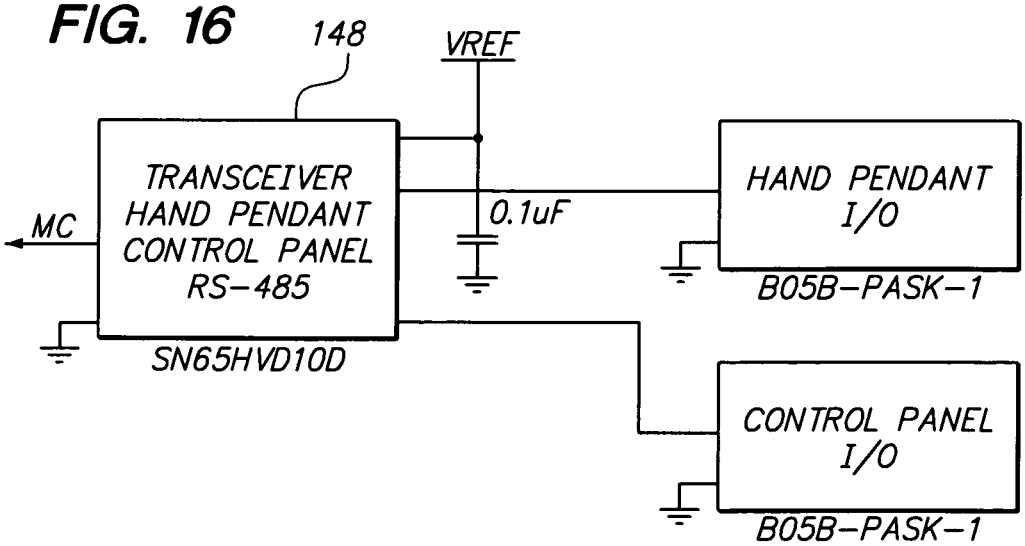
FIG. 16 is an electrical schematic of the RS 485 transceiver for the hand pendant or control panel.

Transceivers, FIGS. 15 and 16 convert reference voltages to RS-485 signals constituting a standard communication bus. Transceiver 146 is associated with the I/Os 146 and 148 for the head and foot motors found on the head end 32 of surgery table 10 and the foot end 34 of surgery table 10, respectively. Main controller 140 also directs power to the motor driver 150, FIG. 12, which is further illustrated in FIGS. 17-20.

Figure 17:
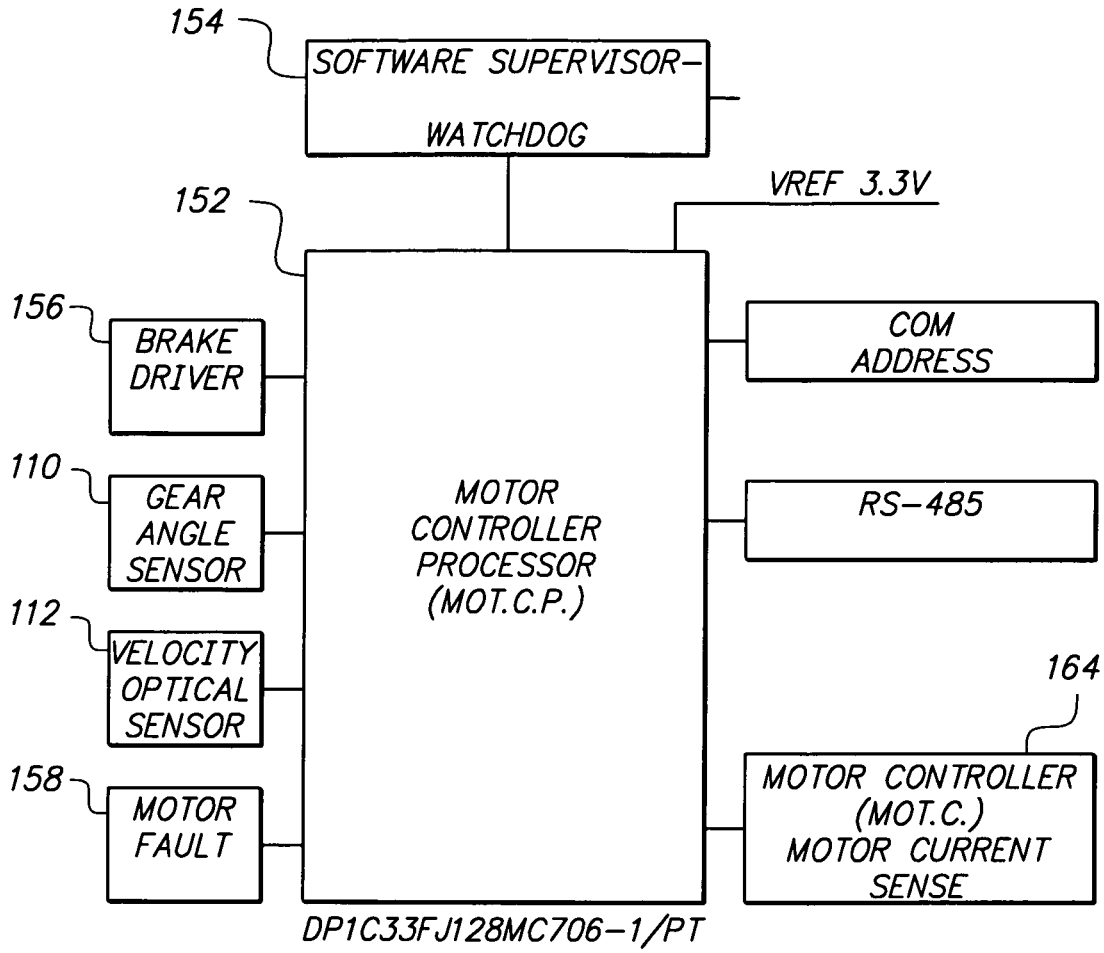
FIG. 17 is a block diagram of the motor controller processor in relation to components of the surgery table.
Figure 18:
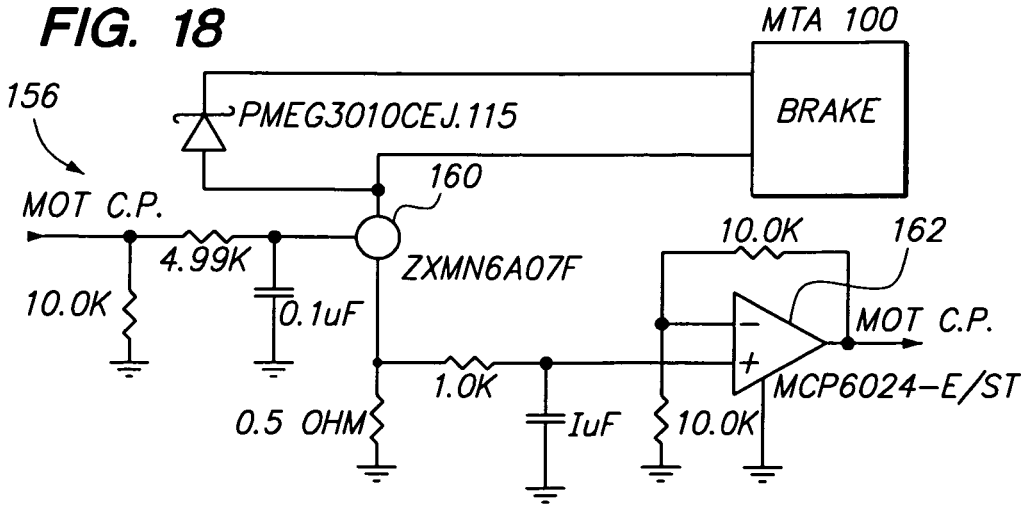
FIG. 18 is an electrical schematic of the motor brake driver.
Figure 19:
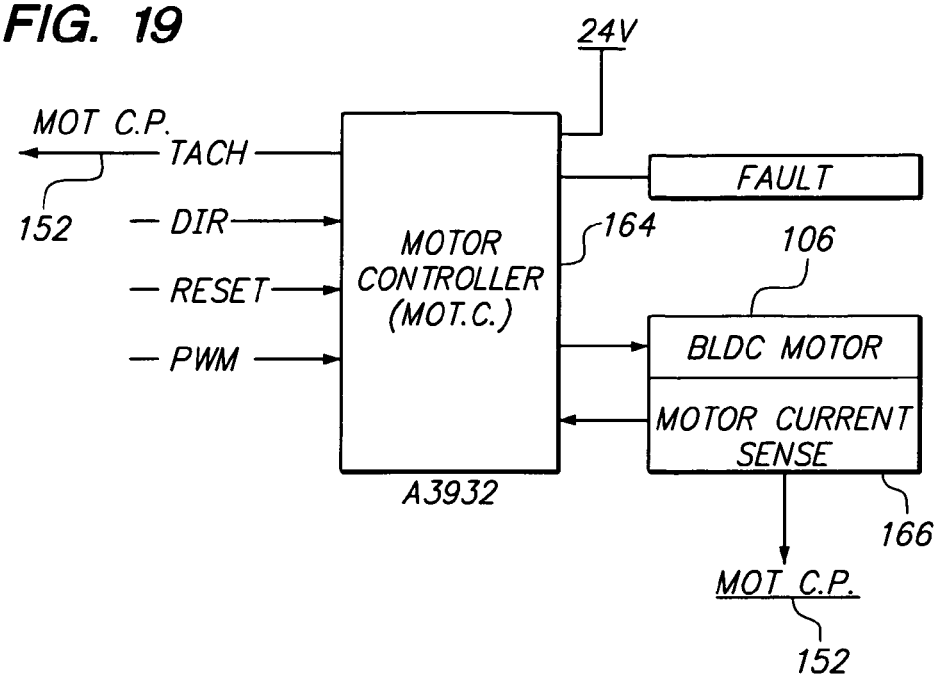
FIG. 19 is a block diagram of the motor controller and related components.

Referring now to FIG. 17, a motor controller processor motor driver 150 motivates each single brushless DC motor, such as DC motor 106, FIG. 8. Motor driver 150 includes a motor controller processor 152 which receives commands from main controller 140. Motor control processor 152 also receives sensor information from each sensors associated with each motor, such as velocity optical sensor 112 and absolute sensor or encoder 110 reference in FIG. 8. Again, watch dog supervisor 154, similar to supervisor 142 of FIG. 13, monitors the operation of microprocessor 140 and resets the system of controller 118 should software crash occur. Brake driver 156 and motor fault input 158 are also fed into motor controller processor 152. Brake driver 156 is further detailed in FIG. 18. Brake driver 156 receives an input from motor controller 152 which passes to transistor 160. A braking signal passes to motor controller 152 via the amplifier 162. Such braking generally occurs when release of a button occurs on hand pendent 124. Motor controller processor 152 also communicates with motor controller 164, FIG. 19. Typical inputs to motor controller 164 include the direction control (clockwise and counter clockwise), PWM speed control. The run/stop control and the like. Controller is associated with motors, such as motor 106, and also receives feedback on via the sensing of the motor current.

Figure 20:
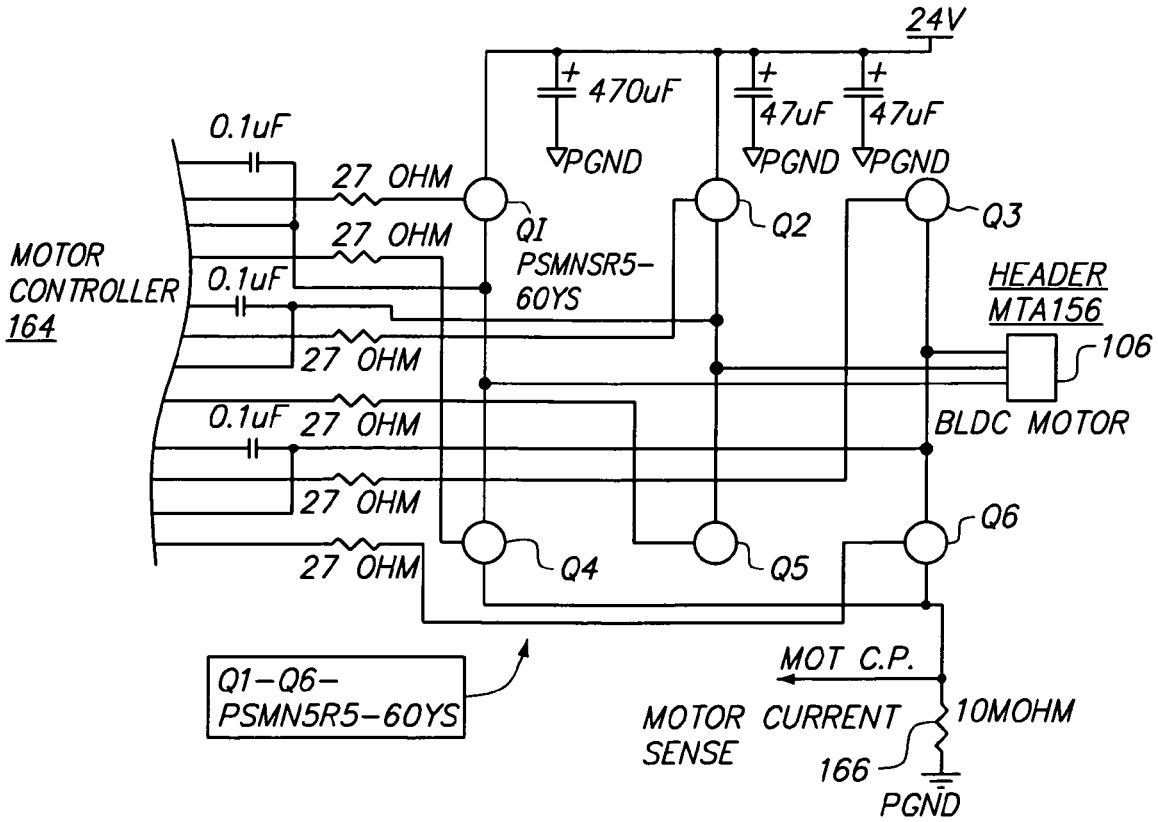
FIG. 20 is an electrical schematic of the motor three phase bridge.

With reference to FIG. 20, it may be apparent that motor controller 164 controls exemplary motor 106 by the use of a bridge utilizing six field effect transistors, Q1-Q6, of identical configuration. Resistir 166 comprises a current sense resistir and is sent to motor controller 164. Thus, motor controller processor 152 and motor controller 164 associated with a motor, such as motor 106, operates the run/stop control, speed, and direction of each motor. It should be noted that each motor runs on 24 volts which is, again, provided by conventional power management systems. It should also be realized that microprocessor 152 and motor controller 164 for each motor 106 utilizes the encoders or sensors 110 or 112 which indicate the position of the shaft of each motor as well as the velocity of each motor, respectively.

In operation, the user of surgery table would normally position a patient on platform 90 which is slidably movable relative to frame 12. Using hand pendant 124, the particular position of the patient would be determined by simple pressing and holding one of the buttons found in button overlay 128. Release of the button would fix such position to allow the medical practitioner to operate on the patient found on plate form 90. The computer program or software 120, found as an appendix to this application, coordinates the movement of positioning mechanism 56 and 58 at the foot end and head end surgery table 10 in an appropriate manner. Also, the position of platform 90 would, likewise, be controlled in a coordinated manner, as heretofore described. Most importantly, a fixed surgical site 88 may be maintained with respect to surgery table 10 during various movements signaled by the user of hand pendent 124 through controller 118. Through such a system, the surgery table 10 may achieve any of the positions found on pendant 124 which are illustrated, in part, in FIGS. 2-7.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A surgery table apparatus for a patient, positioned on a ground surface comprising:

a. a first support member;

b. a second support member hingedly attached to said first support member to form a frame for orienting the patient;

c. a first connector joining said first support member;

d. a second connector joining said second support member;

e. a first pier, said first pier including a base, and a first column extending from and joined to said base;

f. a second pier, said second pier including a base, a second column extending from and joined to said base, said second column linked to said second connector;

g. one positioning mechanism linked to said first connector, said positioning mechanism comprising a first arm having a proximal portion and a distal portion, said first arm proximal portion being axially rotatable relative to said first column, said distal portion of said first arm being moveable toward or away from said second column upon said axial rotation of said first arm proximal portion, and a second arm, said second arm having a proximal portion and a distal portion, said second arm proximal portion being directly linked to and being axially rotatable about an axis on said distal portion of said first arm, said distal portion of said second arm being rotatably attached to said first connector; and h. a controller, said controller actuating the degree of rotation of said proximal portions of said first and second arms of said one positioning mechanism to actuate a rotatable movement of said first support member.

2. The apparatus of claim 1 in which said linked to said second column pier comprises another positioning mechanism, said another positioning mechanism further comprising a first arm having a proximal portion and a distal portion, said first arm proximal portion being axially rotatable relative to said first column, and second arm, said second arm proximal portion being linked to and being axially rotatable relative to said distal portion of said first arm, said distal portion of said second arm being rotatably attached to said second connector, and said controller is further actuating the degree of rotation of said proximal portions of said first and second arms of said another positioning mechanism to actuate a rotatable movement of said second support member.

3. The apparatus of claim 2 in which said controller further acquires a fixed position relative to the ground surface and substantially maintains the distance between said fixed position and a point selectively on said first and second support members during movement, selectively, of said first and second support members.

4. The apparatus of claim 2 which additionally comprises a first rotating motor for urging rotation of said first arm of said one positioning mechanism relative to said first column, and a second rotating motor for urging rotation of said second arm of said one positioning mechanism relative to said second arm of said one positioning mechanism.

5. The apparatus of claim 4 which additionally comprises a third rotating motor for urging rotation of said first arm of said another positioning mechanism relative to said second column and a fourth rotating motor for urging rotation of said second arm of said another positioning mechanism relative to said second arm of said another positioning mechanism.

6. The apparatus of claim 2 which additionally comprises a patient platform, said patient platform being slidable relative to said frame upon rotational movement of said first or second members.

7. The apparatus of claim 4 which additionally comprises one sensor for determining the angle of rotation of said first and second motors, said determining of said angle of rotation of said first and second motors by said one sensor being communicated to said controller.

8. The apparatus of claim 7 which additionally comprises another sensor for determining the velocity of rotation of said first and second motors, said determining of said velocity of said first and second motors by said another sensor being communicated to said controller.

9. The apparatus of claim 1 in which said controller additionally comprises a manually operable command actuator for generating a signal representing a desired degree of rotation of said first and second arms of said one positioning mechanism.

10. The apparatus of claim 1 in which said controller further comprises a microprocessor effected by a computer program to actuate the degree of rotation of said proximal portions of said first and second arms of said one positioning mechanism.

11. The apparatus of claim 10 in which said controller additionally comprises a manually operable command actuator for generating a signal representing a desired degree of rotation of said first and second arms of said one positioning mechanism.

12. The apparatus of claim 10 in which said controller further acquires a fixed position relative to the ground surface and substantially maintains the distance between said fixed position and a point selectively on said first and second support members during movement, selectively, of said first and second support members.

13. The apparatus of claim 10 which additionally comprises a patient platform, said patient platform being slidable relative to said frame upon rotational movement of said first or second members.

14. The apparatus of claim 2 in which said controller further comprises a microprocessor effected by a computer program to actuate the degree of rotation of said proximal portions of said first and second arms of said one and another positioning mechanisms.

15. The apparatus of claim 14 in which said controller additionally comprises a manually operable command actuator for generating a signal representing a desired degree of rotation of said first and second arms of said one and another positioning mechanisms.

16. The apparatus of claim 15 in which said controller further acquires a fixed position relative to the ground surface and maintains the distance between said fixed position and a point selectively on said first and second support members during movement, selectively, of said first and second support members.

17. The apparatus of claim 16 which additionally comprises a patient platform said patient platform being slidable relative to said frame, upon rotational movement of said first or second support members.

18. The apparatus of claim 1 which additionally comprises a mechanism to effect lateral tilt of said frame.

* * * * *